US007125012B2

(12) United States Patent
Newell et al.

(10) Patent No.: US 7,125,012 B2
(45) Date of Patent: Oct. 24, 2006

(54) ROTATABLE FEED WHEEL FOR SHEET CONVERTING MACHINE

(76) Inventors: Gregory James Newell, 932 10th St., Unit 1, Santa Monica, CA (US) 90403; James H. Tippett, 4509 E. Sumac Dr., Spokane, WA (US) 99223

( * ) Notice: Subject to any disclaimer, the term of this patent is extended or adjusted under 35 U.S.C. 154(b) by 0 days.

(21) Appl. No.: 10/799,137

(22) Filed: Mar. 12, 2004

(65) Prior Publication Data

US 2005/0200070 A1 Sep. 15, 2005

(51) Int. Cl.

| | |
|---|---|
| ***B65H 3/06*** | (2006.01) |
| ***F16C 13/00*** | (2006.01) |
| ***B21K 1/38*** | (2006.01) |
| ***B21K 1/40*** | (2006.01) |

(52) U.S. Cl. ..... 271/109; 271/113; 271/275; 271/314; 198/781.04; 198/781.08; 198/624; 492/28; 492/30; 492/32; 492/45; 492/49; 492/56; 29/894.36; 29/894.361; 29/894.362; 29/894.35; 29/894.351; 29/894.352

(58) Field of Classification Search ..... 271/113, 271/109, 275, 314; 492/28, 30, 32, 49, 45, 492/56; 29/894.36, 894.361, 894.362, 894.35, 29/894.351, 894.352; 198/781.04
See application file for complete search history.

(56) References Cited

U.S. PATENT DOCUMENTS

| | | | | |
|---|---|---|---|---|
| 3,445,130 | A * | 5/1969 | Obenshain | 403/344 |
| 3,529,336 | A * | 9/1970 | Dunnebier et al. | 492/30 |
| 4,045,015 | A | 8/1977 | Sardella | 271/112 |
| 4,472,974 | A * | 9/1984 | Dickson et al. | 73/635 |
| 4,473,221 | A * | 9/1984 | Arai | 271/109 |
| 4,614,335 | A | 9/1986 | Sardella | 271/112 |
| 4,696,624 | A * | 9/1987 | Bass et al. | 417/56 |
| 4,767,480 | A * | 8/1988 | Goldstein | 156/96 |
| 4,934,899 | A * | 6/1990 | Patacca | 415/9 |
| 5,038,922 | A * | 8/1991 | Collins et al. | 198/781.04 |
| 5,184,811 | A | 2/1993 | Sardella et al. | 271/10 |
| 5,383,834 | A * | 1/1995 | Kanome et al. | 492/25 |
| 5,934,763 | A * | 8/1999 | Conradsson et al. | 301/64.701 |
| 6,454,082 | B1 * | 9/2002 | McTaggart et al. | 198/781.02 |
| 6,609,997 | B1 | 8/2003 | Sardella et al. | 493/194 |
| 6,655,474 | B1 * | 12/2003 | Accorroni | 175/58 |
| 2001/0018388 | A1 * | 8/2001 | Moser et al. | 492/45 |

FOREIGN PATENT DOCUMENTS

| | | | |
|---|---|---|---|
| EP | 315754 | A2 * | 5/1989 |
| GB | 2132737 | * | 7/1984 |

OTHER PUBLICATIONS

Applicant Writeup Entitled "Background to the Invention"—4 pages.

* cited by examiner

*Primary Examiner*—Gene O. Crawford
*Assistant Examiner*—Leslie A. Nicholson, III
(74) *Attorney, Agent, or Firm*—John R. Flanagan

(57) ABSTRACT

A feed wheel includes a hub and a discontinuous tread removably fitted about the hub. At leading and trailing ends of the discontinuous tread are mateable non-planar female and male surfaces which interfit with one another and tend to interlock the tread ends together. The tread has locking lugs formed under leading and trailing ends and an intermediate segment of the tread which fit into holes configured and located in the hub complimentarily to the locking lugs. The holes and locking lugs are oriented relative to one another so as to enable the tread to be retained about the hub with the tread ends interlocked together during operation of the feed wheel.

20 Claims, 5 Drawing Sheets

ROTATABLE FEED WHEEL FOR SHEET CONVERTING MACHINE

TECHNICAL FIELD

The present invention generally relates to a paperboard blank or sheet converting machine and, more particularly, is concerned with a rotatable feed wheel employed by the sheet converting machine.

BACKGROUND ART

A typical conventional converting machine used in the processing of sheets of corrugated paperboard and the like has a feed table on a support structure of the machine. The feed table includes a plurality of parallel drive shafts extending between and rotatably mounted to opposite sides of the support structure, multiple rotatable feed wheels spaced along and clamped about the drive shafts for rotation with the shafts, and a plurality of spaced apart grates or plates overlying some of the feed wheels and disposed between others. The sheets of paperboard are loaded in a stack form on the support structure of the machine so as to overlie the feed table. Upper portions of the feed wheels protruding above the plates engage the bottom surface of the lowermost one of the stacked sheets. Rotation of the drive shafts, in turn, rotates the feed wheels through a cycle of controlled acceleration followed by deceleration to cause feeding by the wheels of the lowermost sheet from under the stack to the nip of a pair of feed rolls of the machine located adjacent to the feed table, which feed rolls then transfer the sheet to other downstream processing stations of the machine. Some representative examples of such converting machines are disclosed in U.S. Pat. No. 4,045,015, U.S. Pat. No. 4,614,335, U.S. Pat. No. 5,184,811 and U.S. Pat. No. 6,609,997.

In most of these feed tables, the feed wheels have cylindrical-shaped hubs with annular or ring-shaped treads supported thereabout and commonly made of stretchable polyurethane material which provides a high coefficient of friction gripping peripheral contact with the surface of the sheet. The sheets may need to be accelerated from 0 to 200 fpm in a fraction of a second (eg, at feed rates of up to 400 sheets/min). As it is typically important that the sheet is fed at the correct instant in time (relative to the cycle of the machine) and at the correct speed (to match the machine speed), uniform gripping and wear become the main requirements of the feed wheel treads. As high coefficient of friction gripping materials undergo normal wear, their dimensions change which, in turn, changes the speed at which they feed the sheet. Furthermore, the degree of wear of treads of different wheels may vary and thus the wear may be uneven across the feed table. This is a significant problem since if wear (or lack of wear) occurs more on the treads of some wheels than others the tendency is for the less worn, thus larger diameter, wheels to push that side of the sheet forward faster than more worn, thus smaller diameter, wheels which will increase the likelihood of skewed sheet feeding and pulling on that side of the sheet introduced first to the feed rolls which will further pull the sheet at an angle.

Thus, as they become worn, the feed wheel treads need replacing which requires a certain amount of disassembly and reassembly of the feed table depending upon the type of tread in use. For example, in the case of a more common continuous, or full ring style, tread, the amount of disassembly will typically involve: (a) removal of the plates covering the wheel treads; (b) decoupling the driven shafts from a gearbox and removal of their bearing supports; (c) removal of the driven shafts from the machine; (d) cutting off or socking (forcing) all the treads from the hubs and shafts; (e) then socking on replacement treads from the ends of the shafts and over one or more hubs; and (f) reassembly of the driven shafts and plates to the feed table. These disassembly and reassembly steps typically take 1–2 hours for two mechanics/fitters and require the same amount of production downtime (unscheduled if feed problems are being experienced.)

An alternative to the continuous, or full ring style, tread that has been used to reduce the requirement for performance of some of the aforementioned disassembly and reassembly steps is a discontinuous, or split ring style, tread produced by a planar or straight radial slit or cut through the tread at one location. This discontinuous, or split style, tread permits a wrap around removal and fitting of the tread to a modified hub without the need to sock each tread on the hub. The hub is modified by providing a plurality of peripheral recesses spaced circumferentially thereabout into which fit a plurality of cylindrical shaped locking lugs extending inwardly of the tread body at ninety degree intervals and projecting along axes extending generally parallel to a central axis of the feed wheel.

With respect to this alternative, the grates or plates of the machine that cover most of the space around these treads still require removal to enable maintenance personnel to grip and pull up the worn tread, typically from a side of the tread, to remove them. Thus, this alternative has not been widely adopted by the industry as it still requires some disassembly and reassembly and also lends itself to feed problems as the gap at the planar radial split or join of the tread has a tendency to open up due to the considerable loads that the treads are subjected to as they grip and move the sheet. Thus, to date, the continuous, or full ring style, tread remains the more popular one.

However, further complicating matters, because of the aforementioned uneven wear of the feed wheel treads and the requirement that the replacement of even one tread will necessitate the aforementioned steps involved in machine disassembly and reassembly, the replacement of all treads is typically periodically scheduled and carried out even though some treads will be worn less than others and thus are prematurely discarded. The most common technique of deciding when treads need to be replaced is when it is observed that skewing or loss of register of the sheets has become unacceptably high. Another less common technique is to attempt to measure the height that the treads protrude above the feed grates or plates, which is a laborious and thus inherently inaccurate process.

Further, it should be pointed out that the continuous, or full ring style, tread relies solely on friction (from the undersizing of the inside diameter of the shoulder of the tread relative to the outside diameter of the shoulder of the hub) to keep the tread from indexing (slipping) on the hub. Indexing of the tread on the hub will adversely affect the accuracy of the registration of the sheet.

Consequently, a need still exists for an innovation which will provide a solution to the aforementioned problems of the prior art feed wheels without introducing any new problems in place thereof.

DISCLOSURE OF INVENTION

The present invention provides a rotatable feed wheel for a paperboard sheet converting machine. The feed wheel has a hub and a discontinuous tread fitted thereabout which incorporate various features that solve the aforementioned problems and thereby satisfy the aforementioned need.

These features include mateable non-planar female and male surfaces respectively provided at leading and trailing ends of the tread, defining a discontinuous non-planar join of the tread, which interfit with one another and thereby tend to interlock the tread ends together. Specifically, the configurations of the respective female and male surfaces forming the non-planar tread join, preferably zigzag or V-shaped, are oriented relative to the direction of rotation of the tread such that there is no potential "catch point" created on the tread at the non-planar join that could otherwise result in a board catching and pulling out either the leading or trailing end of the tread.

These features further include locking lugs formed under the respective leading and trailing ends and an opposite intermediate segment of the tread, and holes formed in the hub with configurations complementary to the locking lugs enabling the locking lugs to fit into the holes so as to retain the tread about the hub and the thread ends interlocked with one another during operation of the feed wheel. The locking lugs under the leading and trailing ends of the tread are reversely angularly displaced relative to one another away from respective radial lines through the locking lugs from a central axis of rotational of the feed wheel. The holes in the hub corresponding to these two locking lugs of the tread are disposed in a side-by-side closely spaced apart relation to one another and reversely angularly displaced relative to one another away from the same radial lines from the central axis of rotation of the feed wheel. The reversed angularly displaced, or reversely angled, orientation of the locking lugs and holes relative to the respective radial lines provides a "fish hook" or "inclined plane hook" effect which is advantageous for anchoring the tread on the hub in that a rotational load imposed on the tread (by an accelerating sheet) which tends to pull the trailing portion of the tread away from the hub will, in turn, pull the trailing locking lug further into its corresponding hole of the hub, thereby enhancing retention of the tread on the hub.

Furthermore, the holes of the hub are more angled relative to the respective radial lines than are the locking lugs of the tread. This causes stressing of the locking lugs when they are inserted into the holes and thereby causes the tread ends at the non-planar join of the tread to be pulled together and inward toward the hub. The locations and orientations of the three locking lugs of the tread and corresponding three holes of the hub prevent rotation or indexing of the tread relation to the hub.

These features still further include at least one and preferably a pair of recesses, such as grooves, located circumferentially about the tread and formed to preselected different depths in the outer peripheral surface of the tread to enable a user to quickly make an assessment as to the amount of material that has worn off the outer peripheral surface and thus the outside diameter of the tread.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

BEST MODE FOR CARRYING OUT THE INVENTION

Figure 1:
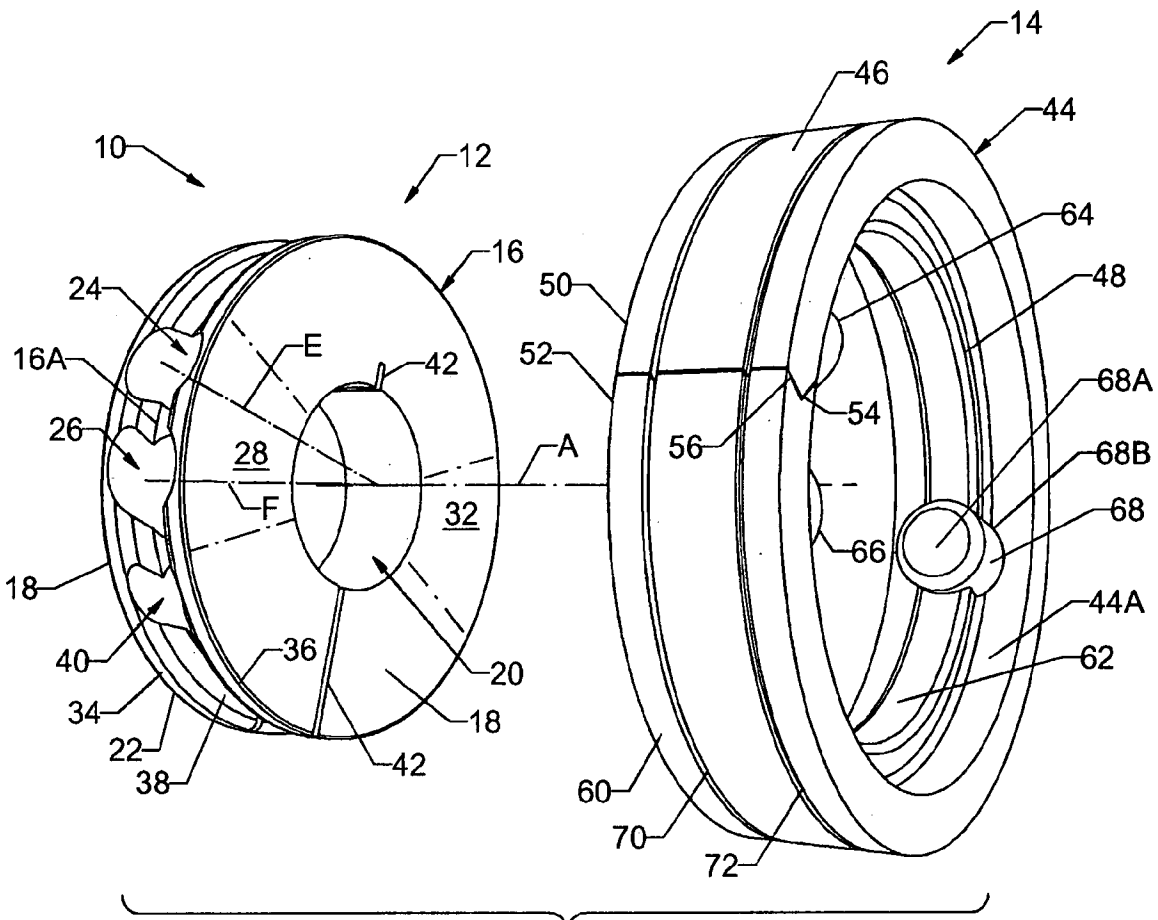
FIG. 1 is a perspective disassembled view of a feed wheel of the present invention.
Figure 3:
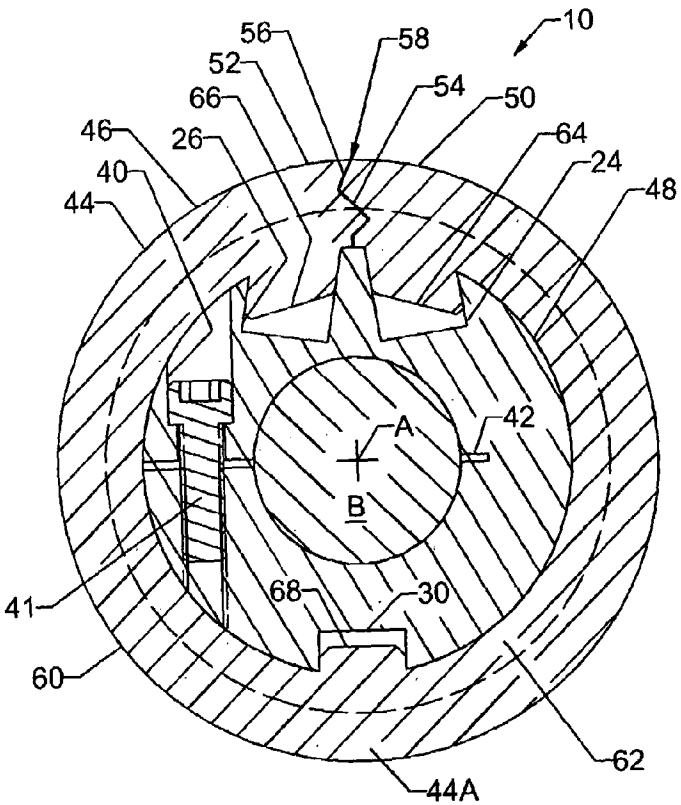
FIG. 3 is a sectional view of the feed wheel taken along line 3—3 of FIG. 2.
Figure 2:
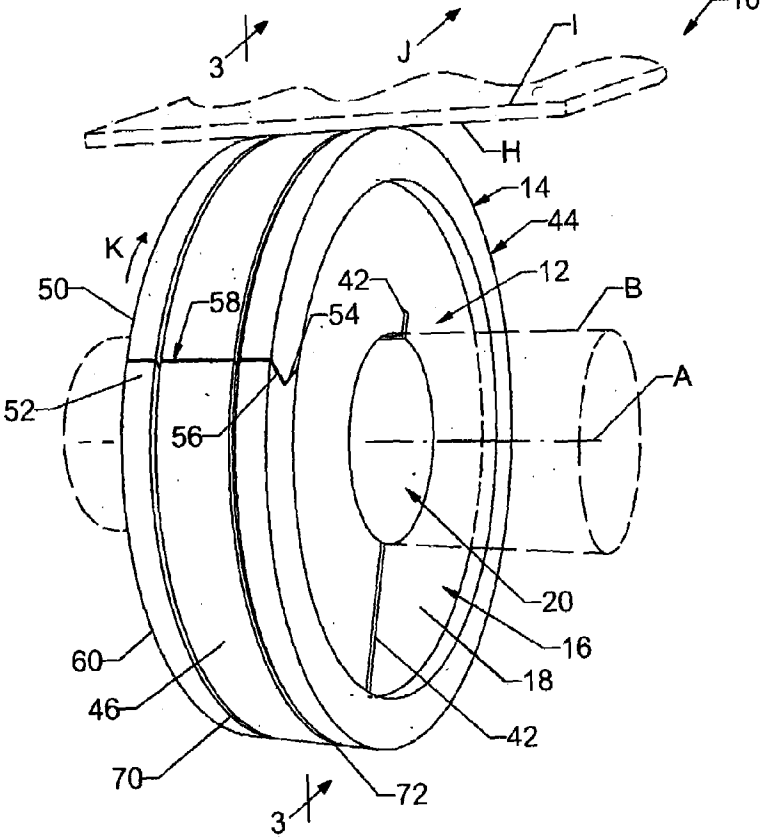
FIG. 2 is a perspective assembled view of the feed wheel of the present invention of FIG. 1.

Referring to the drawings, and particularly to FIGS. 1 and 2, there is illustrated a rotatable feed wheel, generally designated 10, adapted for use on a conventional paperboard sheet converting machine. The rotatable feed wheel 10 basically includes a hub 12 and a discontinuous tread 14 adapted to removably fit on and about the hub 12.

Referring now to FIGS. 1–5, the hub 12 of the feed wheel 10 includes a rigid body 16 made of a suitable material, such as aluminum, and having a substantially cylindrical shape relative to a central axis of rotation A of the hub 12 and wheel 10 extending through the rigid body 16. The rigid body 16 also has a pair of opposite sides 18, which are substantially planar in configuration, spaced apart from one another and facing in opposite directions. The rigid body further has a central bore 20 formed therethrough and an external peripheral surface 22 extending thereabout and between the opposite sides 18 and spaced outwardly from the central bore 20 and central axis of rotation A. The central bore 20 is coaxial with the central axis of rotation A and extends between and is open at the opposite sides 18 of the rigid body 16 for receiving a rotatable shaft B through the central bore 20 such that the rotatable shaft B is coaxially disposed along the central axis of rotation A.

Figure 5:
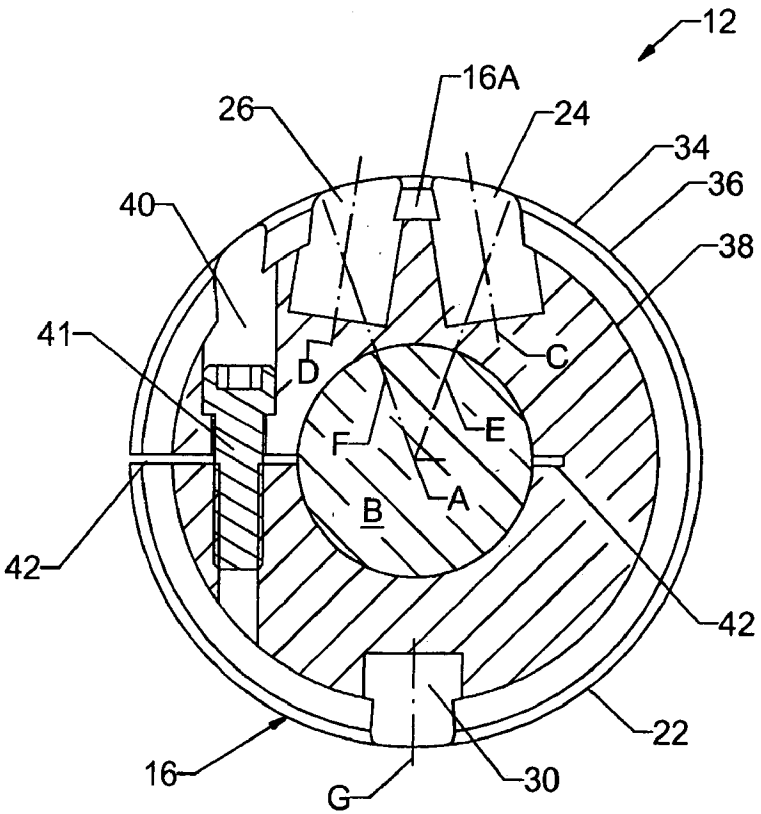
FIG. 5 is a sectional view of the hub taken along line 5—5 of FIG. 4.
Figure 4:
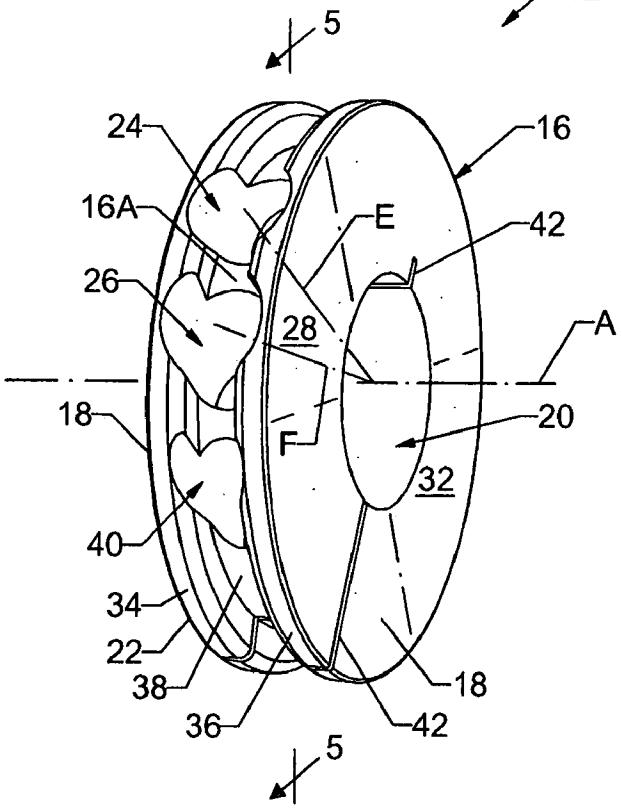
FIG. 4 is a perspective view of a hub of the feed wheel of FIGS. 1 and 2.
Figure 6:
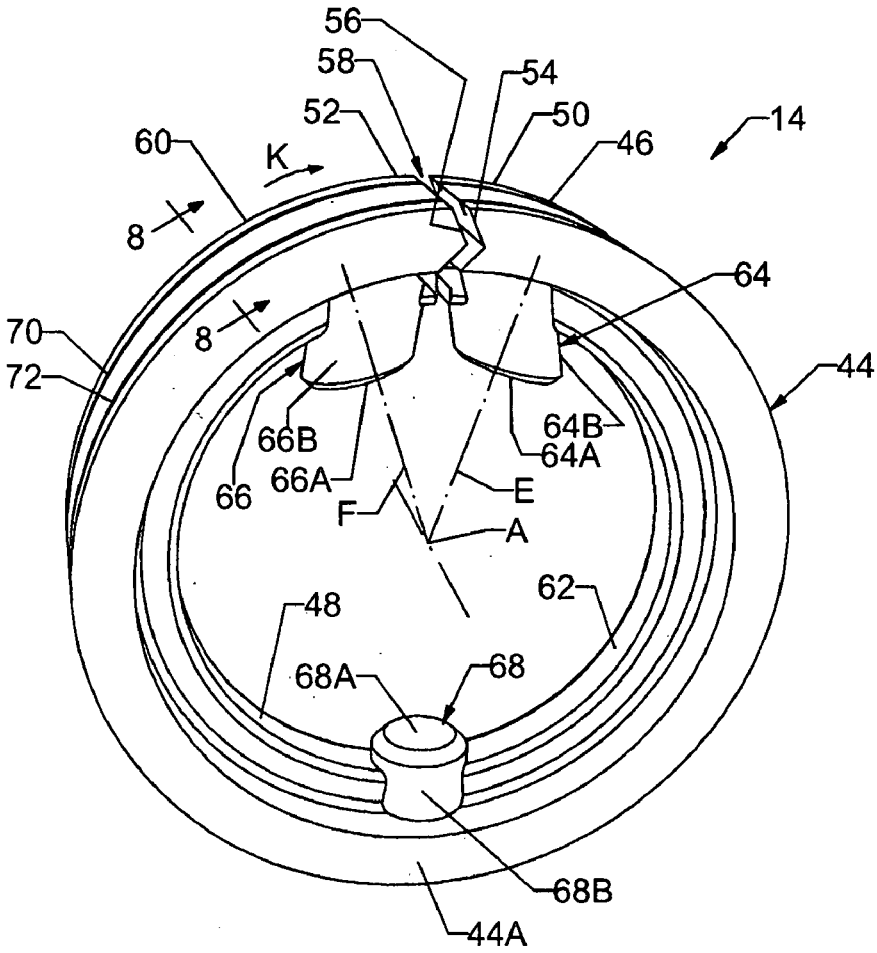
FIG. 6 is a perspective view of a tread of the feed wheel of FIGS. 1 and 2.

Further, the hub 12 has first and second holes 24, 26 defined in a first sector 28 of the rigid body 16 which constitute less than ninety degrees of the rigid body 16. The first and second holes 24, 26, each preferably of cylindrical shape and having a central axis C, D, are disposed in the rigid body 16 in a side-by-side closely spaced apart relation to one another between the opposite sides 18, external peripheral surface 22, and central bore 20 of the rigid body 16. The first and second holes 24, 26 also are open at the external peripheral surface 22 of the rigid body 16. Further, the first and second holes 24, 26, with respect to their central axes C, D, are oppositely or reversely angularly displaced relative to one another away from respective first and second radial lines E, F extending from the central axis of rotation A outwardly through the first and second holes 24, 26, as best seen in FIG. 5. The reason for this orientation of the central axes C, D of the first and second holes 24, 26 will become clear below.

Still further, the hub 12 has a third hole 30, also preferably cylindrical in shape and having a central axis G, which is defined in a second sector 32 of the rigid body 16 which constitutes less than ninety degrees thereof and is disposed opposite from the first sector 28 thereof. The third hole 30 is disposed between the opposite sides 18, external peripheral surface 22, and central bore 20 of the rigid body 16. The third hole 30 also is open at the external peripheral surface 22 of the rigid body 16. Preferably, the third hole 30 is disposed diametrically opposite from a portion 16A of the rigid body 16 located between the first and second holes 24, 26.

Also, as known heretofore, the external peripheral surface 22 of the rigid body 16 of the hub 12 defines a pair of cylindrical shoulders 34, 36 extending about the rigid body 16 and a cylindrical annular channel 38 recessed into the rigid body 16 from between the cylindrical shoulders 38. The first, second and third holes 24, 26, 30 intersect the cylindrical shoulders 34, 36 and annular channel 38 on the rigid body 16. Finally, also as known heretofore, the hub 12 includes suitable means, such as a slanted hole 40 for receiving a suitable fastener 41 to clamp, as permitted by some flexing of the rigid body 16 due to the presence of slits 42 therein, of the rigid body 16 onto the rotatable shaft B for undergoing rotation therewith about the central axis of rotation A.

Referring now to FIGS. 1, 2, 6 and 7, the discontinuous tread 14 of the feed wheel 10 includes a discontinuous annular body 44 having a ring-shaped configuration and made of a resilient pliable stretchable deformable material, such as polyurethane. The annular body 44 has cylindrical-shaped outer and inner peripheral surfaces 46, 48 being spaced apart from one another, and leading and trailing opposite ends 50, 52 respectively having mateable female and male surfaces 54, 56 thereon of non-planar configurations which define a discontinuous non-planar join 58 in the annular body 44 between the outer and inner peripheral surfaces 46, 48 thereof at the leading and trailing opposite ends 50, 52 thereof. The discontinuous join 58 in the annular body 44 readily enables the annular body 44 to be fitted over and about, and also removed from, the rigid body 16 of the hub 12 by yieldably and resiliently deforming and stretching the annular body 44 temporarily out of its normal ring-shaped configuration to and from a seated relationship (seen in FIG. 2) of the annular body 44 at the inner peripheral surface 48 thereof about and with the external peripheral surface 22 of the rigid body 16 of the hub 12. In the seated relationship the annular body 44 of the tread 14 at the outer peripheral surface 46 thereof is adapted to make a gripping contact with a surface H of a sheet I and to cause feeding of the sheet I in a preselected direction J when the annular body 44 of the tread 14 is moved in a given direction of rotation K with the rotatable feed wheel 10 about the central axis of rotation A. The non-planar mateable female and male surfaces 54, 56 respectively formed on the leading and trailing ends 50, 52 of the annular body 44 of the tread 14 are capable of interfitting with one another and thereby tend to interlock the leading and trailing ends 50, 52 together so as to resist the trailing end 52 from being pulled away from the hub 12. It should be noted that as the tread 14 rotates, its leading end 50 passes first, then immediately thereafter it trailing end 52 passes. By the female surface 54 on the leading end 50 substantially overlying and thus holding down the male surface 56 on the trailing end 52 due to their interlocking relationship with one another, the tendency is significantly reduced for the trailing end 52 to be able to be pulled off the hub 12 when subjected to the inertial force of the tread 14 accelerating under and relative to a stationary sheet I. This is because the aforementioned configurations of the female and male surfaces 54, 56 formed at the discontinuous join 58 of the tread 14 are so oriented relative to the direction of rotation K of the tread 14 that there is no potential "catch point" created on the tread 14 at the join 58 that could otherwise result in a board catching and pulling out of an end of the tread 14.

Figure 7:
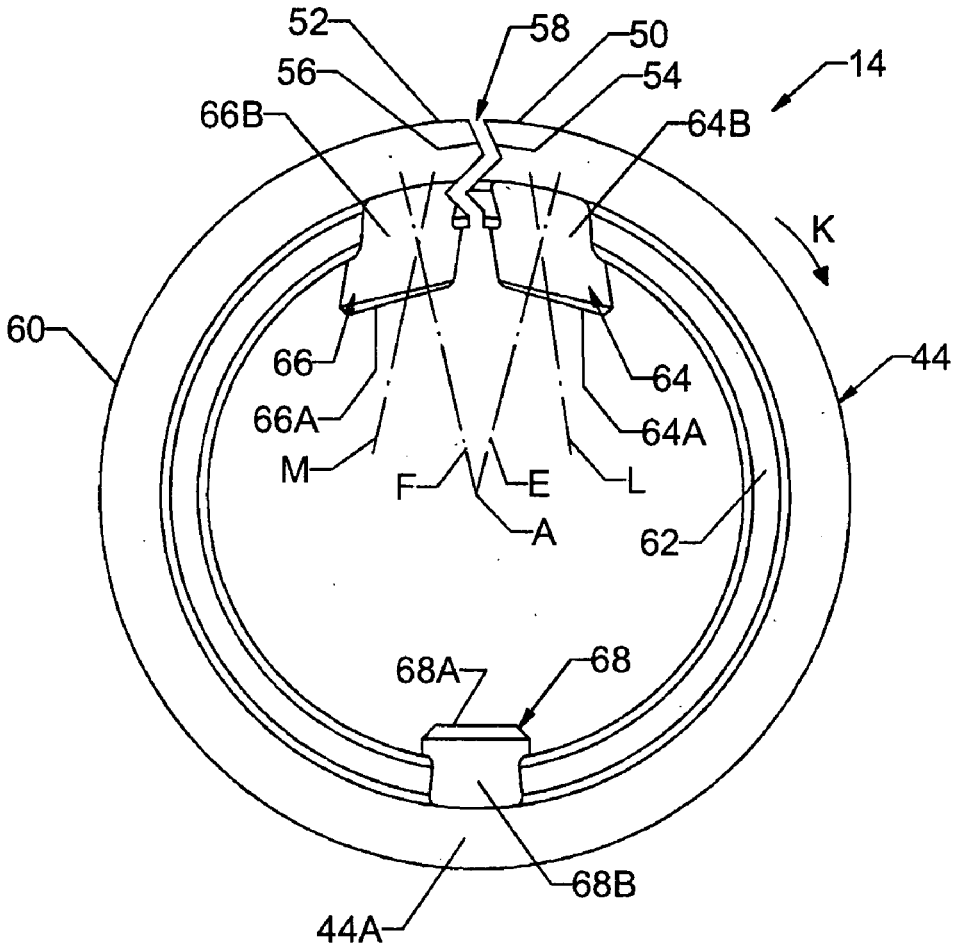
FIG. 7 is a side elevational view of the tread of FIG. 6.

Specifically, the non-planar mateable female and male surfaces 54, 56 on the respective leading and trailing ends 50, 52 of the annular body 44 of the tread 14 preferably have complementary female and male zigzag configurations or V-shaped configurations. It should be understood, however, that it is possible to provide other suitable non-planar configurations. Furthermore, as known heretofore, the annular body 44 includes a tread portion 60 and a spline portion 62 integrally connected to a bottom central region of the tread portion 60 and projecting inwardly therefrom. As seen in FIG. 7, the non-planar mateable female and male surfaces 54, 56 are defined on both the tread portion 60 and spline portion 62 of the annular body 44 of the tread 14 at the respective leading and trailing ends 50, 52 thereof.

The tread 14 also includes a plurality of locking lugs 64–68 formed on the annular body 14 at the inner peripheral surface 48 thereof and projecting inwardly therefrom. The plurality of locking lugs 64–68 includes first and second locking lugs 64, 66 and a third locking lug 68. The first and second locking lugs 64, 66 are of substantially cylindrical configurations, have central axes L, M, and bottom edges 64A, 66A of reverse bevel shape relative to the cylindrical sidewall 64B, 66B of the lugs 64, 66. The first and second lugs 64, 66, with respect to their central axes L, M, are reversely angularly displaced relative to one another away from the radial lines E, F from the central axis of rotation A and are formed under the leading and trailing ends 50, 52 of the annular body 44. The third locking lug 68, also of substantially cylindrical configuration but with a bottom edge 68A of a squared off configuration relative to the cylindrical sidewall 68B of the lug 68, is formed under an opposite intermediate segment 44A of the annular body 44. The first, second and third holes 24, 26, 30 of the hub 12 have substantially complementary shapes and corresponding positions relative to the first, second and third locking lugs 64, 66, 68 so as to enable the locking lugs 64, 66, 68 to fit into the corresponding holes 24, 26, 30 and thereby retain the annular body 44 of the tread 14 on and about the rigid body 16 of the hub 12 and prevent rotation of the tread 14 relative to the hub 12 during rotation of the feed wheel 10 in the predetermined direction K and about the central axis of rotation A.

The first and second locking lugs 64, 66 under the leading and trailing ends 50, 52 of the annular body 44 of the tread 14 are reversely angularly displaced, or angled, relative to one another, with respect to their central axes L, M, away from the respective radial lines E, F extending from the central axis of rotational A of the feed wheel through the first and second locking lugs 64, 66, as best seen in FIG. 7. This reverse angled orientation of the first and second locking lugs 64, 66 of the tread 14 and of the first and second holes 24, 26 of the hub 12 away from the respective radial lines E, F provides a "fish hook" or "inclined plane hook" effect which securely anchors the tread 14 on the hub 12. A rotational load imposed on the tread 14 (such as by an accelerating sheet I) which attempts to pull the trailing portion of the tread 14 away from the hub 14 instead pulls the second or trailing locking lug 66 down further into the corresponding second hole 26 of the hub 12, thereby enhancing retention of the tread 14 on the hub 12.

Additionally, at least one and preferably both the first and second holes 24, 26 of the rigid body 16 of the hub 12, with respect to their central axes C, D, are more angled, relative to the radial lines E, F than are the first and second locking lugs 64, 66 angled relative to the same radial lines E, F, as can be understood by comparing FIGS. 5 and 7. This relationship causes stressing of the first and second locking lugs 64, 66 in order for them to become inserted into the first and second holes 24, 26 and thereby causes the leading and trailing ends 50, 52 of the annular body 44 of the tread 14 to be pulled together and inward toward the hub 14. As an example only and not by way of limitation, the first and second holes 24, 26 can be angled at about 8 degrees off the first and second radial lines E, F whereas the first and second locking lugs 64, 66 can be angled at about 3 degrees off the radial lines E, F, whereby the first and second locking lugs 64, 66 will then be held under stress due to about 5 degrees of interference when installed into the first and second holes 24, 26. At least the second hole 26 for the second or trailing locking lug 66 can be angled at between about 3 degrees and 15 degrees more sharply relative to the radial line F than the trailing locking lug 66 relative to the radial line F. This sharper angle of hole 26 in the hub 12 as compared to the locking lug 66 and the resulting stressed condition of the locking lug 66 means that the more the forces of an accelerating sheet I pulls at the trailing end 52 of the tread 14, the more the angled locking lug 66 at the trailing end 52 of the tread 14 pulls the tread 14 down (circumference-wise) against the hub 12, keeping the non-planar female and male surfaces 54, 56 forming the non-planar join 58 in the tread 14 securely together, eliminating any gap that otherwise might exist at the join 58.

Figure 8:
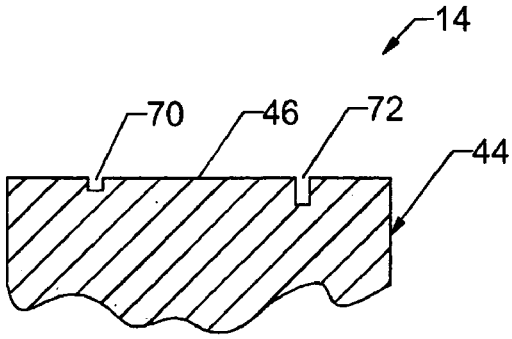
FIG. 8 is an enlarged fragmentary cross-sectional view of the tread taken along line 8—8 of FIG. 6.

As seen in FIG. 8, the tread 14 preferably includes at least one and preferably a pair of recesses, such as grooves 70, 72, laterally spaced apart from one another and located circumferentially about the tread 14. The grooves 70, 72 are formed to preselected different depths, such as 1 mm and 2 mm, in the outer peripheral surface 46 of the tread 14 to enable a user to make an assessment as to the amount of material that has worn off said outer peripheral surface 46 and thus an outside diameter of the tread 14.

It should be mentioned that the cylindrical lug design also allows for a tread's insertion and removal without the need for access from the sides of the treads. This allows removal of worn treads and fitting of new treads without having to remove the plates or grates that surround each wheel (for side access). Further, this design is ideal for the automatic removal of treads. This cylindrical lug design allows the trailing lug to be easily "jimmied" out with a flat screwdriver, so that as the machine is advanced forward the trailing lug then automatically pulls out of its hole and the tread comes entirely out of the hub, without any further intervention from the operator. Also, the urethane lugs that fit into the holes may be slightly oversized to the holes, while having a textured finish, so that the lugs compress as they are inserted, to maintain a constant and even pressure on the lugs, which the texture provides space for the compressed urethane material to fill, securing the lugs in the hub's holes. The cylindrical lug design is well suited to a retrofit situation, as standard hubs can be modified to suit, by simply drilling the required holes.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

The invention claimed is:

1. A rotatable feed wheel for a sheet converting machine, comprising:

(a) a hub including a rigid body having a cylindrical shape relative to an axis of rotation through said rigid body and an external peripheral surface about said rigid body; and (b) a tread including a discontinuous annular body having a ring-shaped configuration and made of a resilient pliable stretchable deformable material, said annular body further having opposing leading and trailing ends with mateable female and male surfaces of complementary non-planar configurations defined respectively on said leading and trailing ends and forming a discontinuous non-planar join through said annular body such that said annular body can be fitted over and about, and also removed from, said rigid body of said hub by yieldably and resiliently deforming and stretching said annular body temporarily out of said ring-shaped configuration to and from a seated relationship of said annular body about and with said external peripheral surface of said rigid body of said hub and such that in said seated relationship an outer peripheral surface of said annular body is adapted to make a gripping contact with a surface of a sheet and to cause feeding of the sheet in a preselected direction when said annular body is moved in a given direction of rotation with the rotatable feed wheel about said axis of rotation;

(c) said hub and tread further including respective elements cooperating together so as to retain said annular body of said tread on and about said rigid body of said hub and prevent rotational movement of said tread relative to said hub and also to retain said non-planar mateable female and male surfaces interfitted with one another during rotation of said feed wheel;

(d) wherein said respective cooperating elements of said hub are a plurality of holes defined in said rigid body and being open at said external peripheral surface thereof;

(e) wherein said respective cooperating elements of said tread are a plurality of locking lugs formed on and protruding inwardly of said annular body, said locking lugs having configurations complementary to configurations of said holes of said hub so as to enable said locking lugs to fit into said holes;

(f) wherein said plurality of holes in said rigid body of said hub includes first and second holes disposed in a side-by-side closely spaced apart relation to one another and being reversely angularly displaced relative to one another away from respective first and second radial lines extending from said axis of rotation through said first and second holes of said rigid body.

2. The feed wheel of claim 1 wherein said non-planar mateable female and male surfaces respectively on said leading and trailing ends of said annular body of said tread have complementary female and male zigzag configurations.

3. The feed wheel of claim 1 wherein said non-planar mateable female and male surfaces respectively on said leading and trailing ends of said annular body of said tread have complementary female and male V-shaped configurations.

4. The feed wheel of claim 1 wherein each of said holes is of cylindrical configuration.

5. The feed wheel of claim 1 wherein each of said locking lugs is of cylindrical configuration.

6. The feed wheel of claim 1 wherein said plurality of locking lugs on said annular body of said tread includes first and second locking lugs respectively on said leading and trailing ends of said annular body and being reversely angularly displaced relative to one another away from said respective first and second radial lines extending from said axis of rotation through said first and second locking lugs of said annular body and adapted to insert into said first and second holes in said rigid body of said hub such that said reversely angularly displaced holes and locking lugs provide a fish hook effect at said leading and trailing ends of said tread anchoring said tread on said hub.

7. The feed wheel of claim 6 wherein said first and second holes in said rigid body of said hub are more angularly displaced relative to said radial lines than are said first and second locking lugs angularly displaced relative to said radial lines which causes stressing of said first and second locking lugs when said locking lugs are inserted into said first and second holes and thereby causes said leading and trailing ends of said annular body of said tread to be pulled together and inward toward said hub so as to maintain said non-planar mateable female and male surfaces respectively formed on said leading and trailing ends of said annular body interfitted and interlocked with one another.

8. The feed wheel of claim 1 wherein said plurality of holes in said rigid body of said hub also includes a third hole disposed opposite from said first and second holes.

9. The feed wheel of claim 8 wherein said plurality of locking lugs on said annular body of said tread also includes a third locking lug disposed on said annular body opposite from said first and second locking lugs and adapted to insert into said third hole in said rigid body of said hub.

10. The feed wheel of claim 1 wherein said tread includes at least a recess circumferentially located about said tread and formed to a preselected depth in said outer peripheral surface of said tread to enable a user to make an assessment as to the amount of said material that has worn off said outer peripheral surface and thus an outside diameter of said tread.

11. A rotatable feed wheel for a sheet converting machine, comprising:

(a) a hub including a rigid body having a cylindrical shape relative to an axis of rotation through said rigid body, an external peripheral surface about said rigid body, and a plurality of holes defined in said rigid body and being open at said external peripheral surface thereof, said plurality of holes including first and second holes disposed in a side-by-side closely spaced apart relation to one another and being reversely angularly displaced relative to one another away from respective first and second radial lines extending from said axis of rotation through said first and second holes of said rigid body; and (b) a tread including a discontinuous annular body having a ring-shaped configuration and made of a resilient pliable stretchable deformable material, said annular body further having opposing leading and trailing ends with mateable surfaces of complementary configurations defined respectively on said leading and trailing ends and forming a discontinuous join through said annular body such that said annular body can be fitted over and about, and also removed from, said rigid body of said hub by yieldably and resiliently deforming and stretching said annular body temporarily out of said ring-shaped configuration to and from a seated relationship of said annular body about and with said external peripheral surface of said rigid body of said hub and such that in said seated relationship said annular body is adapted to make a gripping contact with a surface of a sheet and to cause feeding of the sheet in a preselected direction when said annular body is moved in a given direction of rotation with the rotatable feed wheel about said axis of rotation;

(c) said tread further including a plurality of locking lugs on said annular body having configurations complementary to configurations of said holes of said hub so as to enable said locking lugs to fit into said holes and retain said annular body of said tread on and about said rigid body of said hub so as to prevent rotational movement of said tread relative to said hub during rotation of said feed wheel and further enable said surfaces respectively on said leading and trailing ends of said annular body to contact one another and thereby retain said leading and trailing ends together, said plurality of locking lugs including first and second locking lugs respectively on said leading and trailing ends of said annular body and being reversely angularly displaced relative to one another away from said respective first and second radial lines extending from said axis of rotation through said first and second locking lugs of said annular body and adapted to insert into said first and second holes in said rigid body of said hub such that said reversely angularly displaced holes and locking lugs provide a fish hook effect at said leading and trailing ends of said tread anchoring said tread on said hub.

12. The feed wheel of claim 11 wherein said first and second holes in said rigid body of said hub are more angularly displaced relative to said radial lines than are said first and second locking lugs angularly displaced relative to said radial lines which causes stressing of said first and second locking lugs when said locking lugs are inserted into said first and second holes and thereby causes said leading and trailing ends of said annular body of said tread to be pulled together and inward toward said hub so as to maintain contact between said mateable surfaces on said leading and trailing ends of said annular body.

13. The feed wheel of claim 11 wherein said plurality of holes in said rigid body of said hub also includes a third hole disposed opposite from said first and second holes.

14. The feed wheel of claim 13 wherein said plurality of locking lugs on said annular body of said tread also includes a third locking lug disposed on said annular body opposite from said first and second locking lugs and adapted to insert into said third hole in said rigid body of said hub.

15. The feed wheel of claim 14 wherein each of said holes and locking lugs is of cylindrical configuration.

16. The feed wheel of claim 11 wherein said tread includes at least a recess circumferentially located about said tread and formed to a preselected depth in said outer peripheral surface of said tread to enable a user to make an assessment as to the amount of said material that has worn off said outer peripheral surface and thus an outside diameter of said tread.

17. A hub for a rotatable feed wheel, comprising:

(a) a rigid body having a cylindrical shape relative to a central axis of rotation through said rigid body;

(b) an external peripheral surface on and extending about said rigid body;

(c) first and second holes defined in said rigid body and being disposed in a side-by-side closely spaced apart relationship to one another and open at said external peripheral surface of said rigid body such that said first and second holes are reversely angularly displaced relative to one another away from respective first and second radial lines extending through said first and second holes from said central axis of rotation; and (d) a third hole defined in said rigid body opposite from said first and second holes and open at said external peripheral surface of said rigid body.

18. The hub of claim 17 further comprising:

means for clamping said rigid body onto a rotatable shaft for undergoing rotation therewith about said central axis of rotation.

19. The hub of claim 17 wherein each hole in said rigid body of said hub has a cylindrical configuration.

20. The hub of claim 17 wherein said peripheral surface of said rigid body defines a pair of cylindrical shoulders extending about said rigid body and a cylindrical annular channel recessed into said rigid body from between said cylindrical shoulders such that said first and second holes intersect said cylindrical shoulders and annular channel of said external peripheral surface on said first sector of said rigid body and said third hole intersects said cylindrical shoulders and annular channel of said external peripheral surface on a second sector of said rigid body substantially opposite from said first sector thereof.

* * * * *